US010166546B2

(12) United States Patent
Rehnstrom et al.

(10) Patent No.: US 10,166,546 B2
(45) Date of Patent: Jan. 1, 2019

(54) REDUCED MASS PLATES FOR REFINERS AND DISPERSERS

(71) Applicant: ANDRITZ INC., Glens Falls, NY (US)

(72) Inventors: Mikael Rehnstrom, Ekenas (FI); Ismo Ihalainen, Chester (GB); Yves Raymond, Milton, PA (US)

(73) Assignee: Andritz Inc., Glens Falls, NY (US)

( * ) Notice: Subject to any disclaimer, the term of this patent is extended or adjusted under 35 U.S.C. 154(b) by 1264 days.

(21) Appl. No.: 14/255,379

(22) Filed: Apr. 17, 2014

(65) Prior Publication Data

US 2014/0339348 A1 Nov. 20, 2014

Related U.S. Application Data

(60) Provisional application No. 61/823,566, filed on May 15, 2013.

(51) Int. Cl.

| | |
|---|---|
| ***B02C 7/12*** | (2006.01) |
| ***B02C 7/02*** | (2006.01) |
| ***D21D 1/00*** | (2006.01) |
| ***D21D 1/30*** | (2006.01) |
| ***B22D 31/00*** | (2006.01) |

(52) U.S. Cl.

CPC ..... *B02C 7/12* (2013.01); *B02C 7/02* (2013.01); *B22D 31/002* (2013.01); *D21D 1/008* (2013.01); *D21D 1/306* (2013.01); *Y10T 29/49989* (2015.01)

(58) Field of Classification Search

CPC ..... D21D 1/008; D21D 1/306; B22D 31/002; Y10T 29/49989; B02C 7/12; B02C 7/02

USPC ..... 241/261.2, 261.3, 245–248, 296–298

See application file for complete search history.

(56) References Cited

U.S. PATENT DOCUMENTS 1,160,964 A * 11/1915 Warren ..... B02C 2/10 241/257.1
3,104,837 A * 9/1963 Steinlger ..... D21D 1/306 241/260
3,125,306 A * 3/1964 Kollberg ..... D21D 1/306 241/298

(Continued)

FOREIGN PATENT DOCUMENTS

JP 47-16244 5/1972
JP 51-123718 10/1976

(Continued)

OTHER PUBLICATIONS

Office Action dated Aug. 3, 2016, in a corresponding Japanese Patent Application No. 2014-099151 (3 pages), and a partial English translation thereof (4 pages).

(Continued)

*Primary Examiner* — Sean M Michalski
(74) *Attorney, Agent, or Firm* — Robert Joseph Hornung

(57) ABSTRACT

A light weight plate segment configured to be mounted on a disc of a disperser or refiner for comminuted cellulosic material including: a front face having disperser teeth or refining bars; a back face having a raised post surrounding a fastener attachment structure and a raised plate positioning section; side edges of the plate segment; and a radially outer edge and a radially inner edge extending between the side edges; wherein the back face lacks raised structures along the side edges.

25 Claims, 9 Drawing Sheets

(56) References Cited

U.S. PATENT DOCUMENTS 3,326,480 A * 6/1967 Jones ..... B02C 7/00 241/297
3,387,796 A 6/1968 Cormack et al.
3,910,511 A * 10/1975 Leider ..... B02C 7/06 241/261.3
4,005,827 A * 2/1977 Frair ..... D21D 1/303 241/245
4,023,737 A * 5/1977 Leider ..... B02C 7/12 241/261.3
4,023,739 A 5/1977 Lampe et al.
4,157,669 A * 6/1979 Pilao ..... B23Q 3/08 241/298
4,274,602 A * 6/1981 Johansson ..... D21D 1/306 241/298
4,610,400 A * 9/1986 Sjobom ..... D21D 1/30 241/261.2
4,620,675 A * 11/1986 Kirchner ..... D21D 1/306 241/261.3
4,628,643 A * 12/1986 Gile ..... B24B 49/16 451/21
4,676,440 A * 6/1987 Perkola ..... B02C 7/12 241/261.3
4,896,838 A * 1/1990 Vendelin ..... B02C 13/1842 241/275
5,048,768 A * 9/1991 Bernhard ..... D21B 1/14 241/261.1
5,203,514 A * 4/1993 Mokvist ..... B02C 7/11 241/261.3
5,228,629 A * 7/1993 Bernhard ..... D21D 1/22 241/261.1
5,335,865 A * 8/1994 Kohler ..... D21D 1/30 241/261.2
5,373,995 A * 12/1994 Johannson ..... B02C 7/12 241/17
5,425,508 A * 6/1995 Chaney ..... B02C 7/12 241/261.2
5,449,122 A * 9/1995 Berger ..... B02C 7/12 241/261.2
5,747,707 A * 5/1998 Johansson ..... D21D 1/002 241/261.3
5,823,453 A * 10/1998 Garasimowicz ..... B02C 7/12 241/261.3
5,836,525 A * 11/1998 Garnier ..... D21D 1/306 241/261.2
5,875,982 A * 3/1999 Underberg ..... D21D 1/30 241/261.3
5,979,809 A 11/1999 Bartels et al.
6,024,308 A * 2/2000 Bartels ..... B02C 7/12 241/261.3
6,053,440 A * 4/2000 LaRiviere ..... B02C 7/06 241/261.2
6,189,821 B1 * 2/2001 James ..... B02C 7/12 241/297
6,250,573 B1 * 6/2001 Kriebel ..... B01F 7/00758 241/17
6,616,078 B1 * 9/2003 Gingras ..... B02C 7/12 241/261.2
6,969,019 B2 * 11/2005 Aikawa ..... D21D 1/20 241/261.1
7,419,112 B2 * 9/2008 Sjostrom ..... B02C 7/12 241/261.3
7,758,726 B2 * 7/2010 Sabourin ..... B02C 7/12 162/261
7,766,269 B2 * 8/2010 Gingras ..... D21D 1/006 241/261.3
8,061,643 B2 * 11/2011 Gingras ..... D21D 1/30 241/261.2
8,573,521 B2 * 11/2013 Gingras ..... D21D 1/30 241/28
9,181,654 B2 * 11/2015 Gingras ..... B02C 7/12
9,670,615 B2 * 6/2017 Gingras ..... D21D 1/24
2002/0070303 A1 * 6/2002 Johansson ..... B02C 7/12 241/261.3
2002/0166912 A1 * 11/2002 Schneid ..... D21D 1/008 241/298
2003/0071155 A1 * 4/2003 Healey ..... B02C 7/08 241/261.2
2005/0167538 A1 * 8/2005 Doelle ..... D21D 1/306 241/298
2005/0211809 A1 * 9/2005 Lutz ..... B02C 7/11 241/261.2
2006/0175447 A1 * 8/2006 Duggan ..... B02C 7/06 241/261.2
2006/0192040 A1 * 8/2006 Johansson ..... B02C 7/12 241/30
2006/0289689 A1 * 12/2006 Matthew ..... B02C 7/12 241/298
2007/0095962 A1 * 5/2007 Virving ..... B02C 7/12 241/298
2008/0191078 A1 * 8/2008 Gingras ..... D21D 1/306 241/298
2009/0200411 A1 * 8/2009 Stager ..... B27L 11/005 241/296
2009/0242679 A1 * 10/2009 Briggs, Jr. ..... B02C 13/13 241/298
2009/0256020 A1 * 10/2009 Sued ..... B02C 18/0007 241/297
2009/0302140 A1 * 12/2009 Johansson ..... B02C 7/12 241/28
2012/0024999 A1 * 2/2012 Hackl ..... B02C 18/182 241/296
2012/0032014 A1 * 2/2012 Wang ..... B02C 18/0007 241/296
2012/0267459 A1 * 10/2012 Beirakh ..... B02C 7/06 241/27
2013/0284841 A1 * 10/2013 Pellman ..... B02C 18/18 241/246
2014/0196858 A1 * 7/2014 Gingras ..... B02C 7/12 162/4
2014/0339348 A1 * 11/2014 Rehnstrom ..... B22D 31/002 241/298
2016/0045919 A1 * 2/2016 McDaniel ..... B02C 13/18 241/191
2016/0138220 A1 * 5/2016 Gingras ..... D21D 1/306 241/298

FOREIGN PATENT DOCUMENTS

JP 60-501063 7/1985
WO WO 84/04057 10/1984

OTHER PUBLICATIONS

Extended European Search Report, Munich Germany, Application No. 14167866.4-1710/280376, dated Jan. 1, 2015, pp. 1-5.
Chinese Office Action, dated Jun. 12, 2017, Chinese Patent Office, Beijing, China.

* cited by examiner

REDUCED MASS PLATES FOR REFINERS AND DISPERSERS

RELATED APPLICATION

This application claims priority and incorporates by reference U.S. provisional application Ser. No. 61/823,566 filed May 15, 2013.

TECHNICAL FIELD

The disclosure relates to plates and plate segments for refiners and dispersers (also known as dispergers) used in mechanical pulping and paper recycling processes to produce pulp material and recycled pulp material for various end uses.

BACKGROUND OF THE INVENTION

In the production of pulp material to be used in the making of paper or other paper based packaging material. One conventional method is to employ a mechanical refiner. Mechanical refiners include, but are not limited to, refiners to process comminuted cellulosic material such as wood chips, etc. to produce pulp, and dispersers typically used in the processing of recycled paper material. Mechanical refiners typically include a set of opposing discs, such as a pair of flat discs at least one of which rotates, a pair of conically shaped discs, and an assembly of parallel flat and conical discs. As feed material moves through a gap between the opposing discs, fibers in the material are separated to produce refined pulp; ink, and other contaminates may be dispersed from paper to produced a recycle pulp material.

Mechanical refiners that produce pulp from wood chips and other comminuted cellulosic material, typically referred to as refiners, have plates with bars and grooves on the front face of their plates. The plates are mounted on opposing discs. The gap between plates with bars and grooves is typically planer and formed between the upper ridges of the bars on opposing plates. Mechanical refiners used to process recycled paper and paperboard material are typically referred to as dispergers or dispersers, and have plates with teeth on the front face of the plates. The gap between opposing plates in a disperser may have a serpentine shape formed by the intermeshing rows of teeth on the opposing front faces of the plates.

The refining or dispersing action occurs as feed material, e.g., wood chips or recycled paper, enters the gap between the discs through an opening in one of the plates. The feed material is driven by centrifugal force to move radially outwardly through the gap and between the front faces of the plates. The refining or dispersing surfaces on the front faces act on the feed material as the material moves through the gap and is subjected to pulsating forces due to the crossing of the bars or teeth on the plates.

Plates may be formed by an annular assembly of plate segments mounted on the discs. The plates are generally an annular array of plate segments, such as pie shaped segments. The segments are mounted side-by-side to form a circular plate mounted onto the disc mounting surface. The plates have a front face with bars and grooves forming refining surfaces in a pulp refiner or rows of teeth forming dispersing surfaces in a disperser. The gap in the refiner or disperser is formed between the front faces of the plates on the opposing discs. The back faces of the plates are mounted to a disc mounting surface. Bolts and other fasteners hold the plates to the disc mounting surface.

Plate segments, for a convention mechanical refiner (capable of handling high, medium or low consistency feed material) or a disperser (capable of handling recycled material feed material), are a critical component of the refining or dispersing equipment. As the feed material moves across the surface of the plate segments, the surface of the fronts of the plate segments wear down. The refining and dispersion action performed by the plate segments become less effective as the plates wear down. The worn plate segments must be replaced. Generally, plate segments are periodically replaced on refiners and dispersers.

A typical annular array of plate segments for a refiner or disperser includes three (3) to twenty four (24) equally-sized plate segments. At every plate change, all segments of an annular array of plate segments are removed and inspected, mounting surface (surface of the discs) cleaned, and the new segments installed. The plate segments that can be reused are cleaned and new segments are substituted for worn segments, typically all plate segments are replaced but there are times when some plate segments may be cleaned and reused. The cleaned and new segments are mounted one-by-one onto the disc mounting surface. The mounting of each segment requires a shimming process to maintain equal spacing between the segments. The mounting also involves applying a proper torque to the fastener securing the segments to the disc mounting surface.

Refiners and dispersers usually have two annular plates arranged opposite to each other in the refiner. In the twin refiners or twin dispersers, there may be four plates arranged in two opposing pairs of plates. The refiner or disperser may have one rotor (which may be a double-sided rotor in a twin refiner or disperser) facing a stationary stator. Alternatively, the refiner or disperser may have opposite counter-rotating rotors. Regardless of the specific disc configuration, the plate segments mounted to the discs are periodically replaced. Plate segment replacement is needed because the refining or dispersing surface on the segments wears down by the abrasiveness of the feed material rubbing against these surfaces. A worn refining or dispersing surface reduces the efficiency of the refiner or disperser.

Plate segments generally must be rigid and structurally strong. The plate segments must support the front faces that comprise many bars and grooves for refiners and teeth for dispersers, which are subjected to continuous refining or dispersing action of the abrasive feed material as they encounter the feed material, centrifugal forces in the refiner or disperser, and stresses from the fasteners, e.g., bolts, that affix the segments to the disc mounting surface. A minimum plate thickness is conventionally in a range of 1.0 to 1.5 inches (25 to 38 millimeters (mm)). Additionally, the back face of the plate segments conventionally have a network of raised ribs, posts surrounding the bolt holes and other raised structures to provide structural support to the segments and to provide abutments that seat against the disc mounting surface.

The thickness requirement and network of raised structures on the plate segments contribute substantially to the mass of the segments. The segments are formed by casting molding metal. The cast plate segments tend to have a large mass (i.e., heavy in weight), which makes the cast plate segments difficult to handle when replacement is necessary. The large mass of the plate segments increases the cost of casting due to the cost for a large amount of metal, cost of shipping and cost to handle and mount the segments to the disc. It is desirable to produce a plate segment using a less amount of metal while meeting the mounting and structural requirements needed for a structurally strong and rigid segment.

BRIEF DESCRIPTION OF THE INVENTION

A plate segment useful for mechanical refiner plate segments and disperser plate segments has been conceived having a reduced mass (i.e., lighter in weight). The reduction of mass is achieved by minimizing the network of raised ribs and other raised structures on the back face (non-grinder and refining surface) of a conventional plate segment. The novel light weight plate segment has sufficient strength to support the grinding and refining surfaces on the front of the segment without unduly increasing the risk that the segment will break.

The novel plate segment may lack conventional ribs along the edges of the segment, outer diameter (OD) ribs (also referred to as support material), and many (but not all) of the conventional reinforcement ribs or support material. Minimizing the network of raised ribs and other structures reduces the weight of the plate segment by 20 to 40 percent, as compared to conventional plate segments. Using the invention disclosed herein, the network of ribs and other raised structures on the back face of a plate segment may be achieved without adversely affecting the structural integrity and rigidity of the plate segments.

A novel plate segment has been conceived that is configured to be mounted on a disc of a disperser or refiner for comminuted cellulosic material, the segment comprises: a front face including disperser teeth or refining bars; a back face including a raised post surrounding a fastener attachment structure and a raised plate positioning section, and side edges; extending between the side edges are both a radially outer edge and a radially inner edge; wherein the back face lacks raised structures along the side edges.

DETAILED DESCRIPTION OF THE INVENTION

It is desirable to provide a refiner or disperser plate segment with mass (i.e., weight) removed from the back face of the plate (i.e., the side adjacent the surface of the disc) while maintaining the strength required to provide refining or dispersing actions without structural damage to the plate segments.

Figure 1:
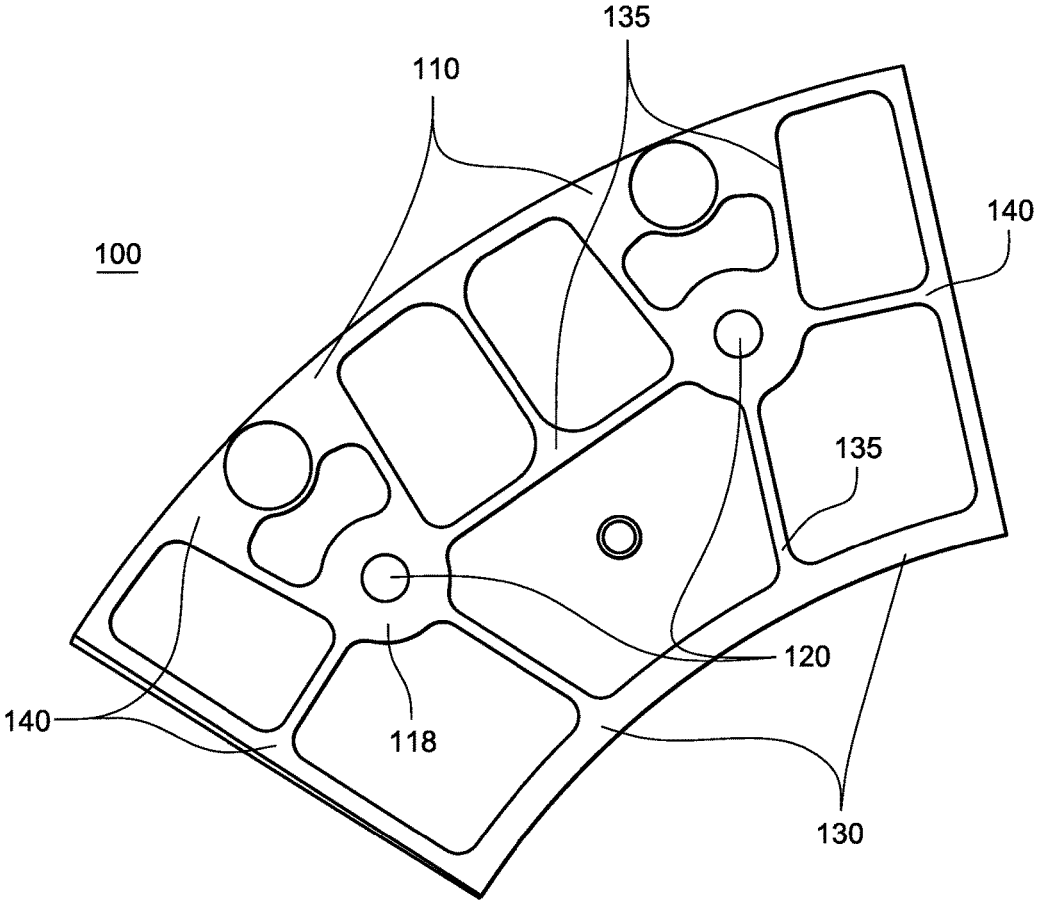
FIG. 1 (Prior Art)
FIG. 1 is a perspective view of a back face of a conventional plate segment suitable for a refiner or disperser, wherein the back face includes a network of raised ribs and other raised structures.

FIG. 1 shows the back face for a conventional plate segment 100. A network of ribs 110 and other raised areas are formed on the back face. The network includes raised posts 118 surrounding bolt holes 120, the edge ribs 140 along the radially outer edge of the plate segment, interior ribs and raised structures 135, and a ring segment 130 of a ring at the radially inward edge of the segment. The network of ribs 110 is intended to provide structural support and rigidity to the conventional plate segment, to reduce the risk that segment will break, and to provide support surfaces that abut against the mounting surface of a disc.

The intended functions served by the network of ribs 110 support the conventional wisdom that such a network is needed on a plate segment. The inventors of the light weight plate segments disclosed herein broke from conventional wisdom. The inventors realized that the conventional network of ribs and other raised areas could be replaced by a reduced arrangement of support posts for each bolt hole and a supporting strip associated with each post.

The back face of a novel plate segment that has reduced mass includes raised posts and raised plate positioning sections. Each raised post surrounds one of the bolt holes and has a mounting surface seated against a disc mounting surface. The raised plate positioning sections are also mounting surfaces that seat against the disc mounting surface. The posts and plate positioning sections provide sufficient mounting surfaces to support the plate segment on the disc mounting surface. They also provide structural support to the plate segment.

The posts and the plate positioning sections fix the position of the plate segment with respect to the plate segment. The posts and plate positioning sections may have the only surfaces on the plate segment that abuts the disc mounting surface. An inner ring segment (arc-edge) on the plate segment may also abut the disc mounting surface and fix the plate segment to the disc. The post, plate positioning sections and inner ring segment support the plate segments. Other raised structures on the back face are not needed to support the plate segments.

A light weight refiner or disperser plate segment has been invented comprising radially inner and outer edges; a front face with refining or dispersing features, a back face including a post providing a bolt hole and a raised plate positioning section, wherein the post and plate positioning section include surfaces configured to abut against a disc mounting surface.

One embodiment of this light weight plate segment removes material from the backside of the segment, such as all side and outer diameter (OD) support material, ribs, or support material being strips or mass of solid metal material, and removes most, but not all, reinforcement ribs or support material other than those supporting the plate positioning sections. The embodiment allows reduction in overall weight of the plate segment. The light weight plate segment is less costly to manufacture, easier and less costly to transport, easier to handle (less manpower required to move and install the plates), quicker to install, and safer to handle in both manufacturing and customer premises. This light weight segment allows customers to further optimize their operating and maintenance processes by providing flexibility in the replacement frequency of the plate segments as the plate segments are quicker, safer and easier to change, thereby reducing the costs associated with their replacement.

In an embodiment of the invention the borders or edges of the plate segment are removed with the exception of the border or edge facing the feed flow (such as the inner periphery or diameter). That is, three of the four plate segment borders or edges are removed. The removal of these plate segment borders or edges (three of the four borders or edges) results in even further reduction of the weight of the plate segment.

A border at the inner periphery or diameter of the plate segments, remains such that a ring (referred to as an inner ring or face ring) is formed at the inner diameter of the plates segments. The inner periphery border is important to support the seal. This inner ring may be formed in one piece and assist in positioning the plate segment on the disc. The inner ring may be a single, solid ring section at the radially inward edge of the plate segment. The inner ring allows for improved congruent placement of the plate segments to the disc mounting surface, thereby forming a smooth, continuous series of plate segments into a complete plate.

A seal may be in a grooved space, e.g., about 0.5 to 2.5 mm, between the inner ring and the disc. The seal may be formed by a suitable material, such as a soft flexible seal material or a hard metal to metal seal material.

The light weight plate segments tend to be easier and safer to handle, less costly to manufacture, and apply lower forces to the disc. Replacement of the conventional plate segments with the light weight plate segments may be accomplished quickly. Due to their lighter weight, there is less risk of physical injury to the mill personnel and to personnel involved in the manufacturing of the light weight plate segments. Light weight plate segments can be moved and mounted to the discs quickly as compared to conventional heavier plate segments.

Because the light weight plate segments may be quickly and easily replaced, the period between plate replacements may be shortened without substantially increasing the overall downtime of the refiner or disperser. As the plate segments may be more frequently replaced without decreasing the operating time for a machine, the surface condition of the plate segments over a machine operating period is better (i.e., less worn) than the conventional solid back heavy plate segments. Thus, using the new light weight plate segments in refiners or dispersers allows for a better refining (e.g., fiber rubbing) or dispersing (e.g., contaminant breakage and further removal) action to be maintained which results in an improved final product.

Figure 2:
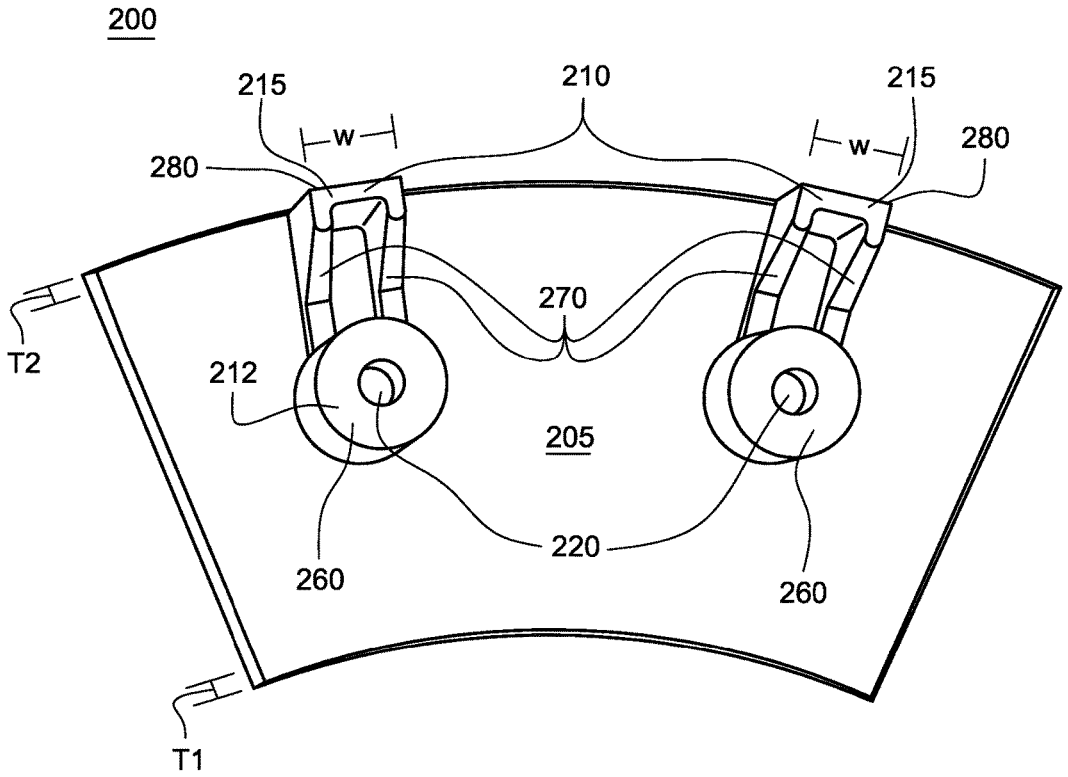
FIG. 2 is a perspective view of a back face of a novel plate segment suitable for a refiner or disperser, wherein the back face lacks the raised ribs shown in FIG. 1, and has raised bolt hole posts and plate positioning ribs aligned with the posts.

FIG. 2 shows the back face of a light weight plate segment 200 for a plate segment according to one embodiment of the invention (reference numbers are similarly labeled for similar parts as in FIG. 1). It has been found a significant amount of the mass (i.e., weight), can be removed from a conventional plate segment without losing structural integrity while providing a light weight plate segment 200.

The back face of the light weight plate segment 200 is a substantially flat surface 205, which has a thickness T1, T2 similar to the thickness of the narrowest thickness of a conventional plate segment. The flat surface 205 may be truly planar or may have a slight curvature along a radial direction. The thickness T1, T2 of the light weight plate segment 200 may be substantially constant over the flat surface 205, or the thickness T1, T2 may gradually narrow in a radially outward direction. For example, T1 may be wider than T2 by a factor of 1.2 to 2.5. The thickness T1, T2 may be measured from the flat surface 205 of the back face to the front face and particularly to the bottom of the grooves between the bars on the front face or to the mounting surface at the bottom of the teeth on the front face. The thickness T1, T2 may be in a range of 1.0 to 1.5 inches (25 to 38 millimeters (mm)).

The back face of the light weight plate segment 200 lacks the extensive conventional network of ribs 110 and other raised surfaces, such as shown in FIG. 1. In particular, the segment 200 lacks raised edge ribs 140. The interior ribs 270 are limited to ribs extending from the posts 260 surrounding the bolt holes 220. The surfaces on the back face that abut the mounting surface of the disc mounting surface (see FIG. 5) may be limited to the upper surfaces of the posts 260 and the upper and side surfaces of plate positioning sections that are radially outward of the posts 260. Other surfaces of the back face, such as the substantially flat surface 205, may not touch the surface of the disc that opposes the back surface. An inner ring-section may be included along a radially inward edge of the segment (see FIGS. 3 to 12). The inner ring-section may also abut the surface of the disc mounting surface 205.

The plate positioning sections 210 and the posts 260 surrounding each of the bolt holes 220 may be the primary raised sections on the back face of the light weight plate segment 200. The plate positioning sections 210 and posts 260 may also include the contact surfaces 212, 215 that abut the disc mounting surface and support the plate segment when mounted to the disc mounting surface. If the disc mounting surface has a flat contact surface, then the contact surfaces 212 on the posts 260 and the contact surfaces 215 on the plate positioning sections 210 may be substantially flat and in a common plane. Alternatively, if the disc mounting surface is conical, the contact surfaces 212, 215 may conform to a conical surface. The contact surfaces 212, 215 cooperate with bolt fasteners to align the light weight plate segments 200 with respect to the disc mounting surface, and the bolt fasteners and contact surfaces 212, 215 carry the forces applied to the light weight plate segments 200.

The plate positioning sections 210 may also have an outer sidewall with a contact surface 280 that abuts a rim or post 260 on the disc mounting surface. The sidewall contact surfaces 280 align the radial position of the plate segment on the disc mounting surface and carry radial forces applied to the plate segment 200. The sidewall contact surfaces 280 replace the "butt pads" on conventional plate segments.

The plate positioning sections 210 may be at the radially outer edge of the plate segment 200 or on the back face between the outer edge and the post 260. Each plate positioning section 210 may be radially aligned with a post 260 such that a radial line from an axis of the disc to which the plate segment 200 is mounted passes through both the post 260 and the plate positioning section 210. Ribs, such as parallel ribs 270 extend from the post 260 to the plate positioning sections 210. The ribs 270 may have a height less than the height of the post 260 or plate positioning sections 210. The ribs 270 may also be a pair of ribs 270 extending from the post 260 to the plate positioning section 210. The ribs 270 provide structural support for the plate positioning sections 210 and posts 260. The ribs 270 may extend along radial lines from an axis of the disc or be parallel pairs of ribs 270.

In some embodiments, the ribs 270 may have the same height as the outer periphery plate positioning sections 210 (solid material sections) and may end at the post 260 where the height at the plate positioning section 210 end is in a range of between the post 260 height and half the height of post 260.

The width W of the contact surface 215 on the plate positioning sections 210 may be substantially, e.g., within 20 percent, of the diameter of the post 260. For example, the width W of the contact surface 215 and diameter of the post 260 may be in a range of 3 mm to 30 mm. The height of the plate positioning section 210 and post 260 may also be substantially, e.g., within 20 percent, the same or in a range of 2 mm to 50 mm.

Figure 3:
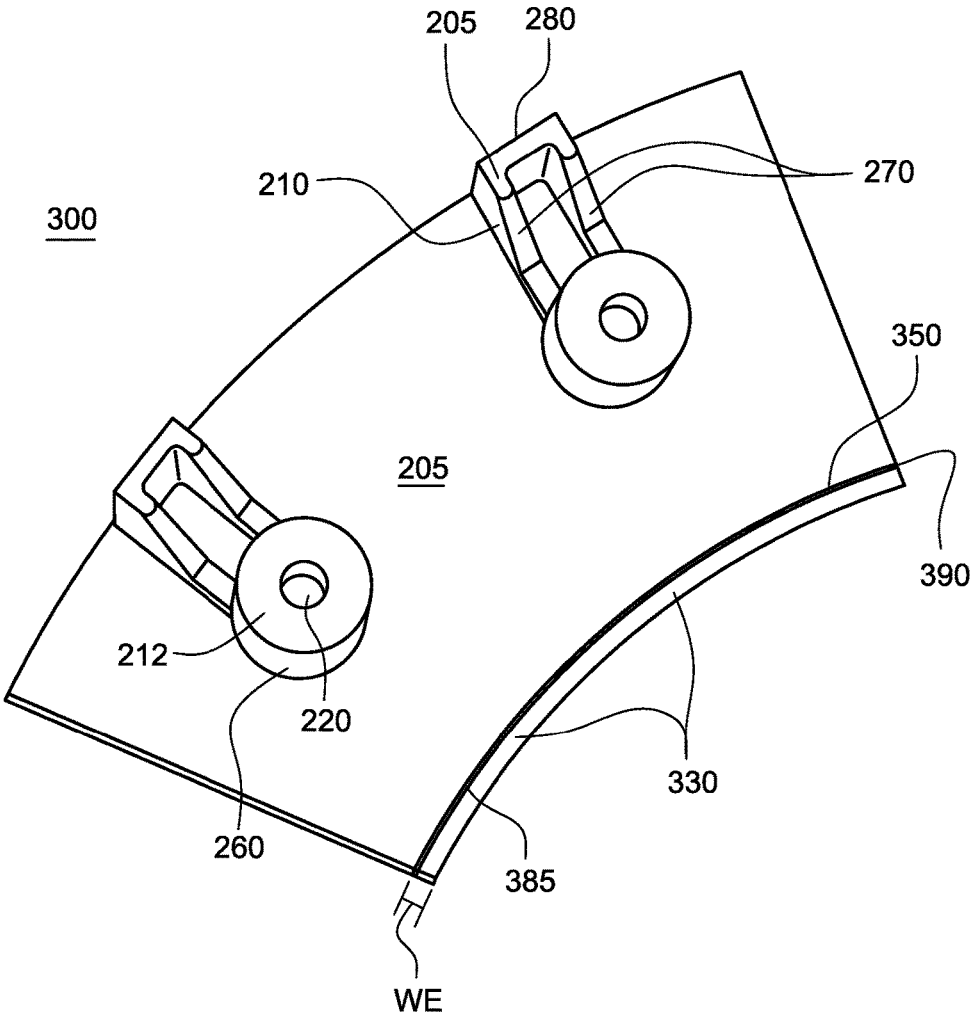
FIG. 3 is a perspective view of another novel plate segment including a ring-section along an inner edge of the segment.

FIG. 3 shows the back face of a second embodiment of the light weight plate segment 300 (reference numbers are similar for similar parts as FIG. 2). An inner ring 330 abuts a radially inward edge of the light weight plate segment 300. The inner ring 330 may be an annular ring fixed to the disc mounting surface to form an abutting surface to the inner edges of the light weight plate segments 300. In another embodiment, the inner ring 330 may be separate from the disc mounting surface. The inner ring 330 forms a dam or seal between the disc mounting surface and light weight plate segment 300 to prevent loose feed material and debris from entering a region between the back face of the light weight plate segment 300 and disc mounting surface.

The inner ring 330 may be a separate component from the light weight plate segment 300 to avoid adding mass to the plate segment. The inner ring 330 may be a one piece annular ring that fits around the center cap (not shown) of the refiner or disperser. The inner ring 330 may have a width WE of approximately 1 inch (25 mm) and a height substantially the same as the thickness of the light weight plate segment 300 at the inner most edge 385 of the light weight plate segment 300. A seal 390 may be placed between the inner most edge 385 of the light weight plate segment 300 and the outermost edge 350 of the inner ring 330. The seal 390 is made of suitable material (material capable of withstanding the operating environment of temperature, chemicals, etc. in a refiner or disperser).

During manufacturing, e.g., casting, of the light weight plate segments 300, tighter tolerances on the sides of the light weight plate segments 300 may be to reduce the opening between adjacent light weight plate segments 300 when mounted to the stator or the rotor disc, thereby removing the need for a raised border (such as edge rib 140 shown in FIG. 1) along the side edges. The light weight plate segments 300 may either be cast or machined to achieve tighter tolerances. When using the inner ring 330 along with the tighter manufacturing tolerances, little or no material will flow behind the light weight plate segment 300 by way of the opening in between the light weight plate segments 300 when placed side-by-side to form a complete plate.

The inner ring 330 prevents feed material entering the region between the plate segments and mounting surface of the disc. Feed material going between the plate segment and the mounting surface of the disc cause plate segment balance problems. If the light weight plate segments 300 become off balance, the refiner or disperser machine may begin to vibrate and would need to be shut down for cleaning and replacement of the light weight plate segments 300 (the same being true for conventional plate segments 100 as shown in FIG. 1).

The inner ring 330 may be the thickness of the thickest part of the light weight plate segment 300, and may be removed from the surface of the disc or may remain in position on the disc allowing for easy removal of the light weight plate segment 300. The inner ring 330 may also be part of the center cap of the refiner or disperser. The inner ring 330 as a functional feature may also be integrated into the center cap, so that it is not a separate part.

This inner ring 330 need not come in direct contact with the light weight plate segments 300. Its primary purpose is to prevent the fiber material from getting to the back side of the light weight plate segments 300. The light weight plate segments 300 can be either cast or machined to achieve tight enough tolerances in between them, so that the fiber does not go behind the light weight plate segments 300. Outer diameter edge of the light weight plate segments 300 is left open with the idea that centrifugal force will keep the area free of unwanted material. The material of the inner ring 330 is a material suitable for use in the abrasive environment experienced by plate segments of the refiner and disperser machines.

Figure 4:
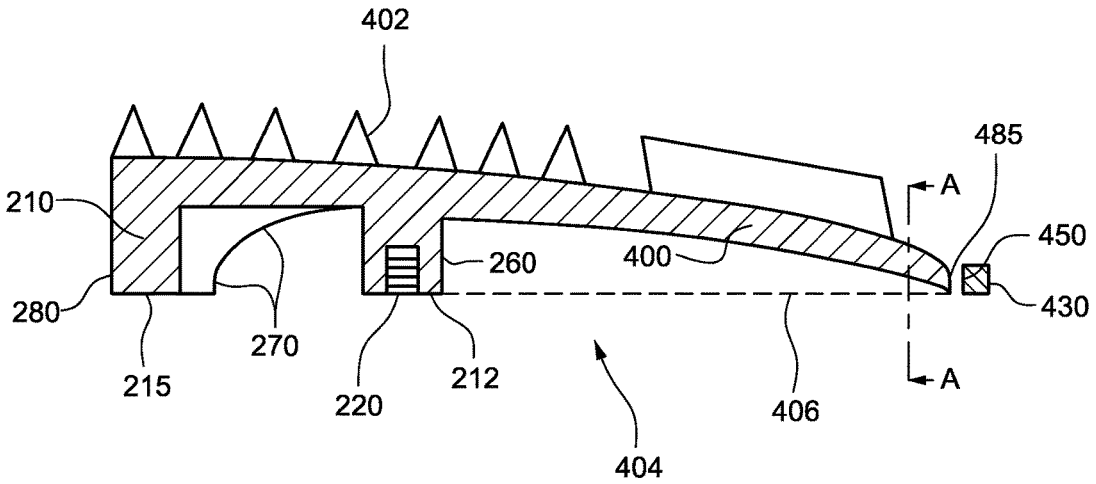
FIG. 4 is a cross-sectional side view of the novel plate segment with a ring-section separated from an inner edge section defined by line A-A.

FIG. 4 is a cross-sectional view of the side of the light weight plate segment 400 and the inner ring 430. The front face has teeth 402 as would be on a disperser plate. The teeth 402 are also representative of the bars on a refining plate. The reduced mass of the light weight plate segment 400 is evident from the minimal raised structures on the back face 404. The structures include the post 260 surrounding the bolt hole 220 and the plate positioning section 210. The ribs 270 may be tapered to reduce their mass while providing structural support for the plate positioning section 210. The back face 404 may only abut a mounting surface of a disc via contact surfaces 215 and 210. Other surfaces on the back face 404 may not touch the mounting surface of the disc.

The contact surface 215 on the positioning section 210 and contact surface 212 on the post 260 are in substantially the same contact plane 406. The radially inner most edge 485 of the light weight plate segment 400 may also have a contact edge in the contact plane 406. Similarly, the inner ring 430 has a contact surface in the contact plane 406. The contact plane 406 conforms to the mounting surface of the disc. If the mounting surface is not planar, e.g., conical, then the contact surfaces 215 and 212, as well as the inner most edge 485 and inner ring 430 are aligned with the mounting surface and not aligned in a plane.

The light weight plate segment 400 has an inner most edge 485 facing and opposite to the outermost edge 450 of the inner ring 430. The opposing edges may have surfaces designed for one or more of simplicity, supporting a seal between the opposing edges and aligning the plate segment on the disc mounting surface.

Figure 5:
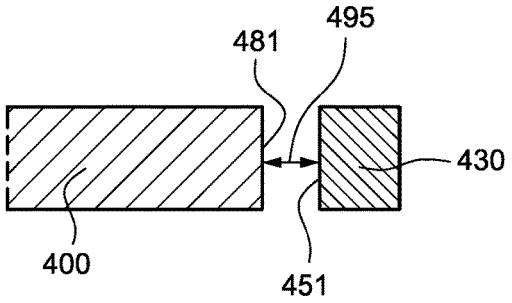
FIG. 5 is a cross-sectional side view of a first embodiment of the ring-section and the inner edge section.

FIG. 5 shows in cross-section an alternative for the radial inner edge region (A-A) of the light weight plate segment 400 (shown in FIG. 4) and the inner ring 430. The opposing edge surfaces 481, 451 of the light weight plate segment 400 and inner ring 430 are straight (linear) in a direction of the axis of the refiner or disperser and arc-shaped in a direction perpendicular to the axis. The opposing edge surfaces 481, 451 have a simple shape. The space 495 between the opposing edge surfaces 481, 451 may be sufficiently narrow such that feed material cannot pass through the space 495 or sufficiently wide to allow a seal to fit in the space 495. For example, the space 495 may be in a range of 0.5 to 2.5 mm, which is sufficiently narrow to prevent feed material entering the region between the back face of the light weight plate segment 400 and the disc mounting surface. The space 495 may be entirely breached by metal to metal contact between the light weight plate segment 400 and inner ring 430 at numerous points in the space 495.

Figure 6:
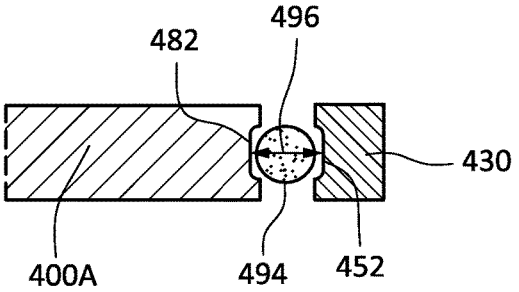
FIG. 6 is a cross-sectional side view of a second embodiment of the ring-section and the inner edge section, wherein a groove space on the inner edge faces a groove space on the ring-section.

FIG. 6 shows in cross-section an alternative light weight plate segment 400A (for the radial inner region (A-A) shown in FIG. 4) and the inner ring 430. In plate segment 400A a grooved space 496 is formed on the opposing edge surfaces 482, 452, of the light weight plate segment 400A and inner ring 430. The grooved space 496 is between raised corners on each edge surfaces 482, 452. The grooved space 496 formed between the opposing edge surfaces 482, 452 receives a flexible seal 494 (such as a flexible o-ring or gasket or other suitable insert). The seal 494 fills the grooved space 496 and prevents feed material entering the region between the back face of the light weight plate segment 400 and the disc mounting surface.

Figure 7:
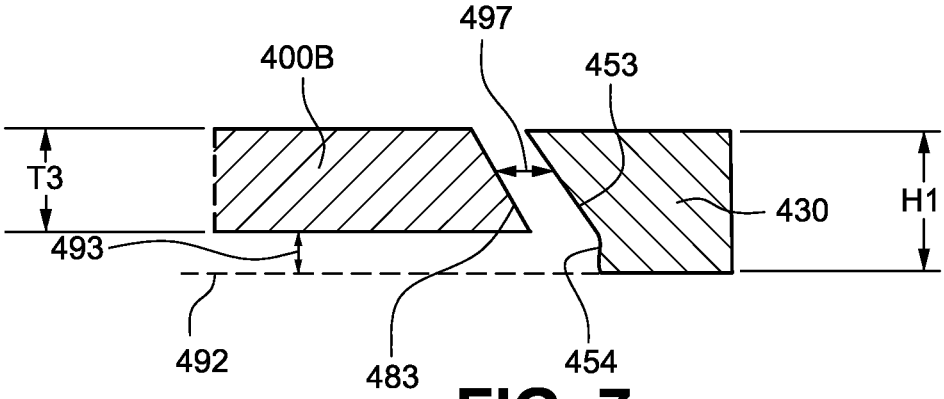
FIG. 7 is a cross-sectional side view of a third embodiment of the ring-section and the inner edge section, wherein the ring-section and the inner edge section have abutting slanted surfaces.

FIG. 7 shows in cross section an additional alternative light weight plate segment 400B (for the radial inner region (A-A) of the plate in FIG. 4) and the inner ring 430. The inner edge surface 483 of the light weight plate segment 400B is slanted, e.g., oblique, with respect to the axis of a refiner disc. The slanted inner edge surface 483 faces a slanted edge surface 453 on the inner ring 430. The slanted space 497 between the parallel inner edge surface 483 and the slanted edge surface 453 is also slanted. The slanted space 497 may have a space of between 0.5 to 2.5 mm, or sufficiently narrow, when used with the straight lower surface 454 of the outermost edge of the inner ring 430 to prevent material entering from the refining/dispersing surface of the refiner plate segments and becoming lodged in the region between the backside of the light weight plate segment 400B and the disc mounting surface.

The inner ring 430 may also include a lower surface 454 that is not slanted, e.g., parallel to the axis of the disc. The corner between the lower surface 454 and the slanted edge surface 453 provides an abutment to the slanted inner edge surface 483 of the light weight plate segment 400B. The abutment assists in preventing debris and feed material from passing through the slanted space 497.

In FIG. 7, the inner ring 430 has a height H1 greater than the thickness T3 of the light weight plate segment 400B. The lower surface 454 of the inner ring 430 extends through a region 493 between the back face of the plate segment and the disc mounting surface 492.

Figure 8:
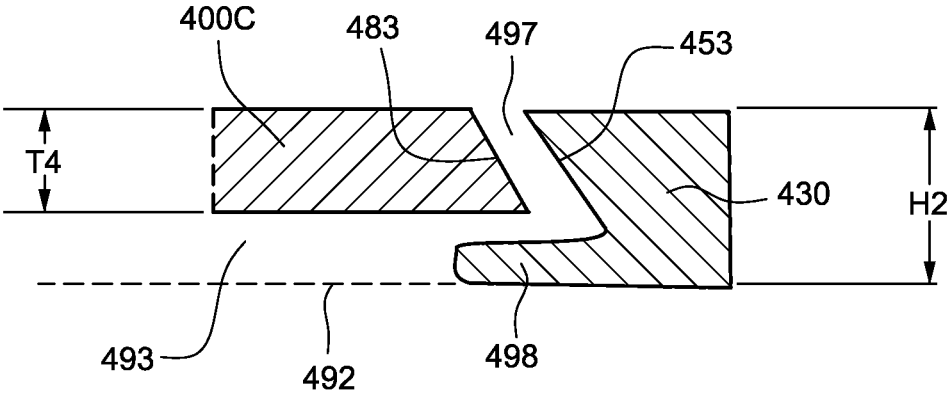
FIG. 8 is a cross-sectional side view of a fourth embodiment of the ring-section and the inner edge section, wherein the ring-section and the inner edge section have abutting slanted surfaces.

FIG. 8 shows in cross section yet another possible alternative light weight plate segment 400C (for the radial inner edge region (A-A) in FIG. 4) and the inner ring 430, wherein an inner lip 498 on the inner ring 430 may support the inner edge region of the light weight plate segment 400C. The light weight plate segment 400C includes a slanted inner ring edge surface 483 and faces a slanted edge surface 453 of the inner ring 430. The height H2 of the inner ring 430 is greater than the thickness T4 of the light weight plate segment 400C.

The inner lip 498 extends radially outward under an inner portion of the light weight plate segment 400C. The inner lip 498 and the corner between the inner lip 498 and slanted space 497 prevent feed material and debris from entering the region 493 between the light weight plate segment 400C and disc mounting surface 492. A seal (not shown) may be positioned in the region 493 and between the inner lip 498 and the light weight plate segment 400C.

Figure 9:
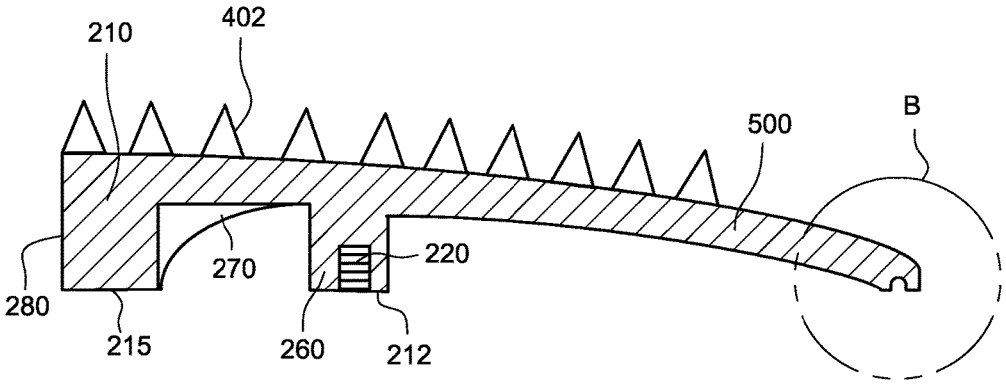
FIG. 9 is a cross-sectional side view of another embodiment of the novel plate segment with an inner edge section defined by line circle B.
Figure 10:
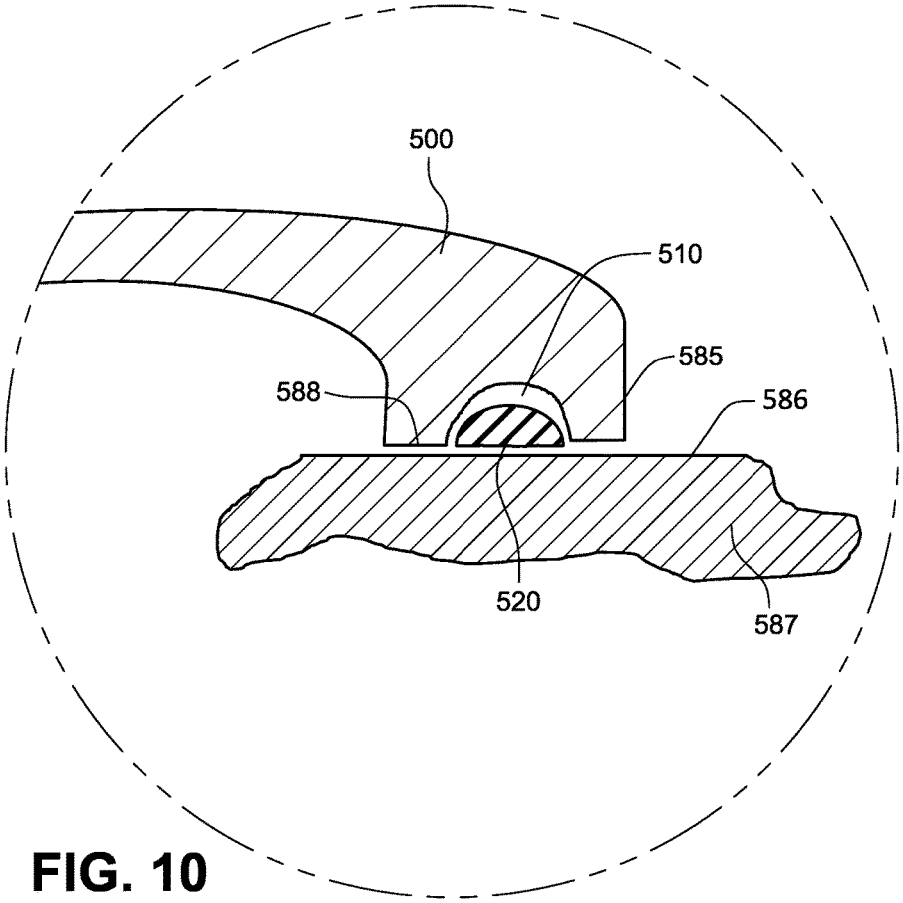
FIG. 10 is a cross-sectional side view of the inner edge section shown in FIG. 9 abutting a disc mounting surface.

FIG. 9 is a cross-sectional view of a light weight plate segment 500 and FIG. 10 is an enlarged cross-sectional view of section B shown in FIG. 9. The inner most edge 585 of the light weight plate segment 500 is configured to be adjacent the disc mounting surface 586 of the annular disc 587. The contact surfaces 212 on the post 260 and contact surface 215 on the plate positioning section 210 abut the disc mounting surface 586. A back face ring section 588 faces the mounting surface 586. A grooved sector 510 in the back face ring section 588 receives a seal 520, e.g., a deformable annular seal, which may be fixed to the disc mounting surface 586 or be separate from both the light weight plate segment 500 and the disc mounting surface 586. The seal 520 may have a cross sectional shape that is circular, oval, rectangular, triangular, octagonal, or combinations there of, or any suitable shape that may be suitable to be received by grooved sector 510.

The grooved sector 510 may be located near and radially outward of the inner most edge 585 of the light weight plate segment 500. The seal 520 between the back face ring section 588 and disc mounting surface 586 prevents feed material and debris entering the region between the light weight plate segment 500 and disc mounting surface 586.

Figure 11:
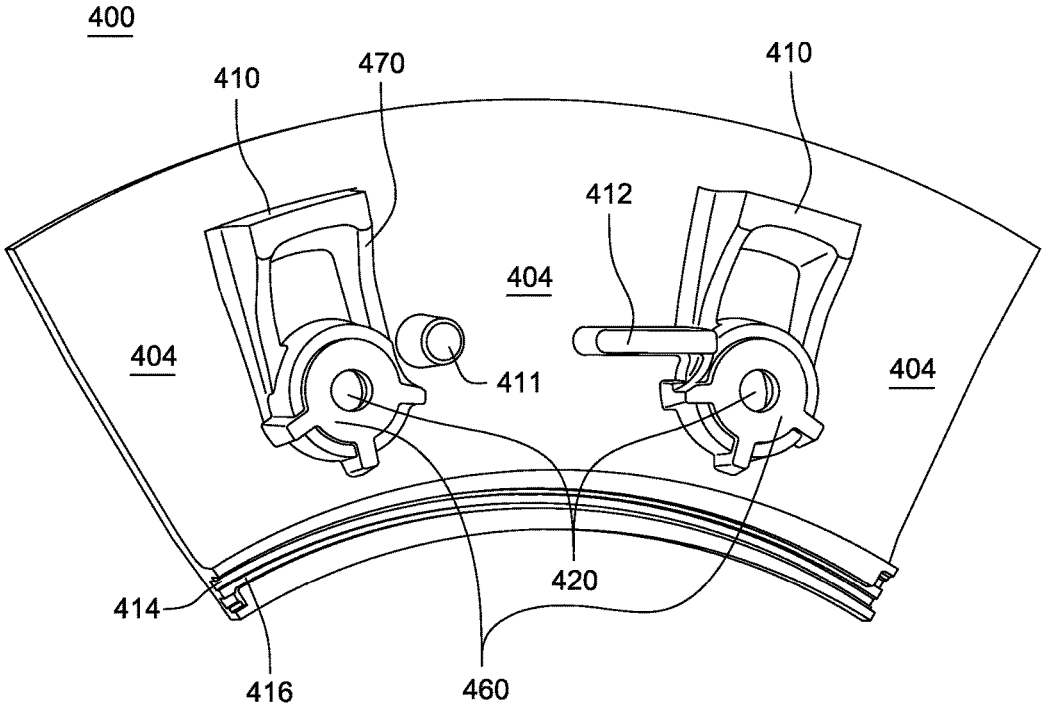
FIG. 11 is a perspective view of another embodiment of the novel plate segment including a ring section along the inner edge of the segment.

FIG. 11 shows another light weight plate segment 400 having a back face 404 which is largely devoid of raised structures. The post 460 for the bolt holes 420, the plate positioning sections 410 and ribs 470 are similar to raised structures shown in FIGS. 2, 3 and 9. The raised structures may also include a finger 411 and bar 412 which provide for grasping by devices for moving the light weight plate segment 400 while not attached to a disc mounting surface (especially during the manufacturing process). Even with the finger 411, bar 412, post 460 and plate positioning sections 410, the back face 404 remains largely unencumbered by raised surfaces and the mass associated with extensive raised surfaces. In some embodiments, finger 411 and bar 412 may not be present.

The inner most edge 414 is similar to the inner most edge 585 shown in FIG. 10. The inner most edge 414 has a back face 404 configured to oppose the disc mounting surface. A grooved sector 416 is similar to the grooved sector 510 in FIG. 10, and is configured to seat over a seal (not shown) on a mounting surface.

Figure 12:
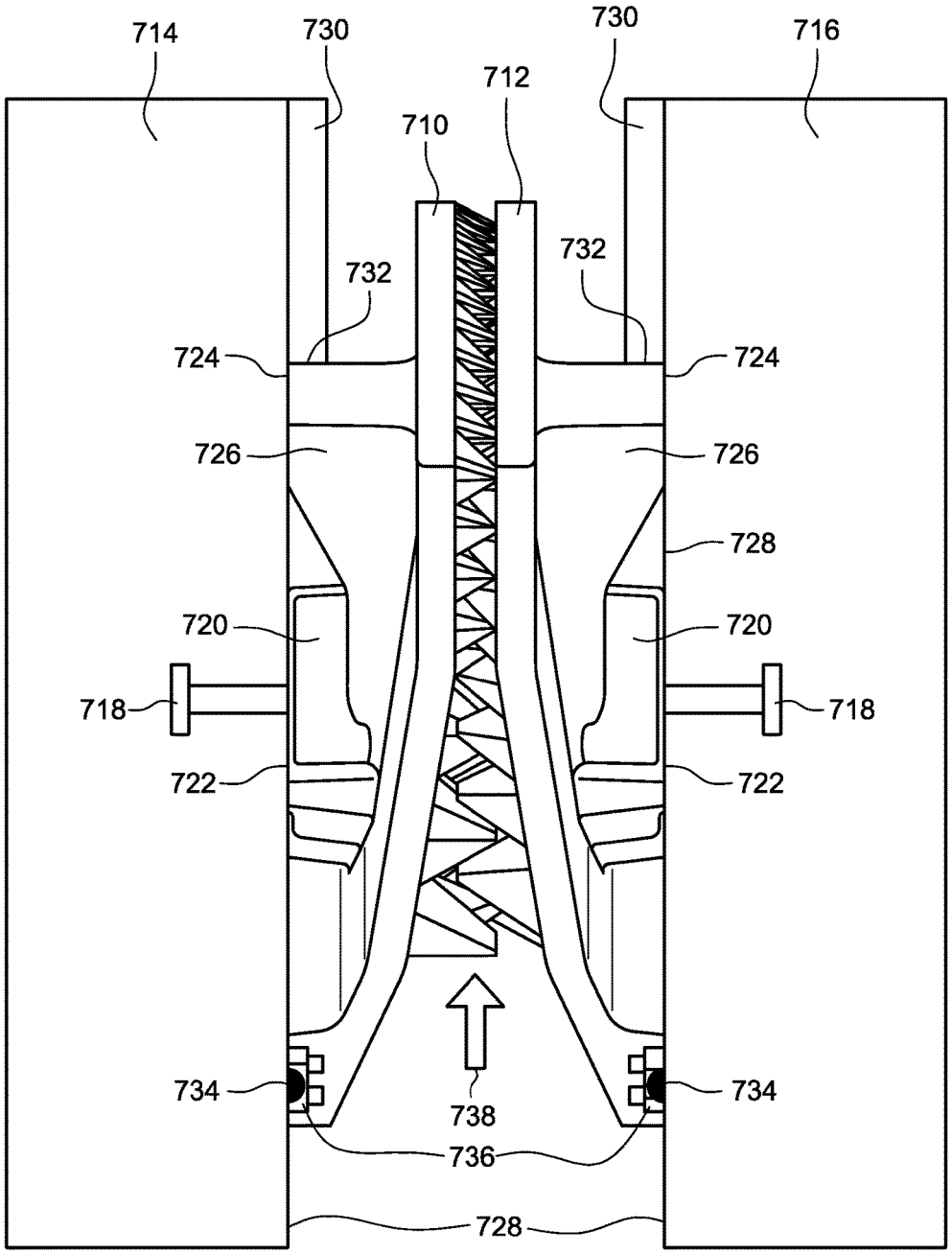
FIG. 12 is a side view of opposing plate segments each mounted to a disc mounting surface.

FIG. 12 is a side view of a pair of light weight plate segments 710, 712 each mounted on a mounting surface of a disc 714, 716. The light weight plate segments 710, 712 are arranged side-by-side to form an annular array on the mounting surface of the disc 714, 716. The plate segments 710, 712 are mounted onto the mounting surface of the disc 714, and not mounted onto adjacent plate segments in the annular array. The disc 714, 716 may be a rotor and a stator disc of a disperser (as shown in FIG. 12) and the light weight plate segments 710, 712 may have teeth for dispersing ink and other contaminants from recycled paper and other materials. The plate segments may alternatively have bars and grooves and be mounted to discs for a refiner (not shown).

A fastener, such as a bolt 718, extends from the disc 714, 716 into the bolt holes of the posts 720 on the back face of the light weight plate segments 710, 712. The bolts 718 fasten the light weight plate segment 710, 712 to the disc 714, 716. The contact surface 722 on the post 720 and the contact surface 724 on the plate positioning sections 726 abut the disc mounting surface 728 of the disc 714, 716. The bolt fastener and the abutments between the contact surfaces 722 and the mounting surface 728 fix the light weight plate segment 710, 712 to the disc 714, 716.

A ledge 730 on disc mounting surface 728 may abut a sidewall contact surface 732 on each of the plate positioning sections 726. The ledge 730 resists radial movement of the light weight plate segment 710, 712 and aligns the light weight plate segment 710, 712 on the disc 714, 716. An annular seal 734 on the disc mounting surface seats in a space 736 on an inner edge region of the light weight plate segment 710, 712. The seal 734 prevents feed material (represented by arrow 738) from getting in the region behind the light weight plate segment 710, 712 and between the light weight plate segment 710, 712 and disc 714, 716. The feed material 738 moves radially outward and between the opposing front faces of the light weight plate segment 710, 712.

Figure 13:
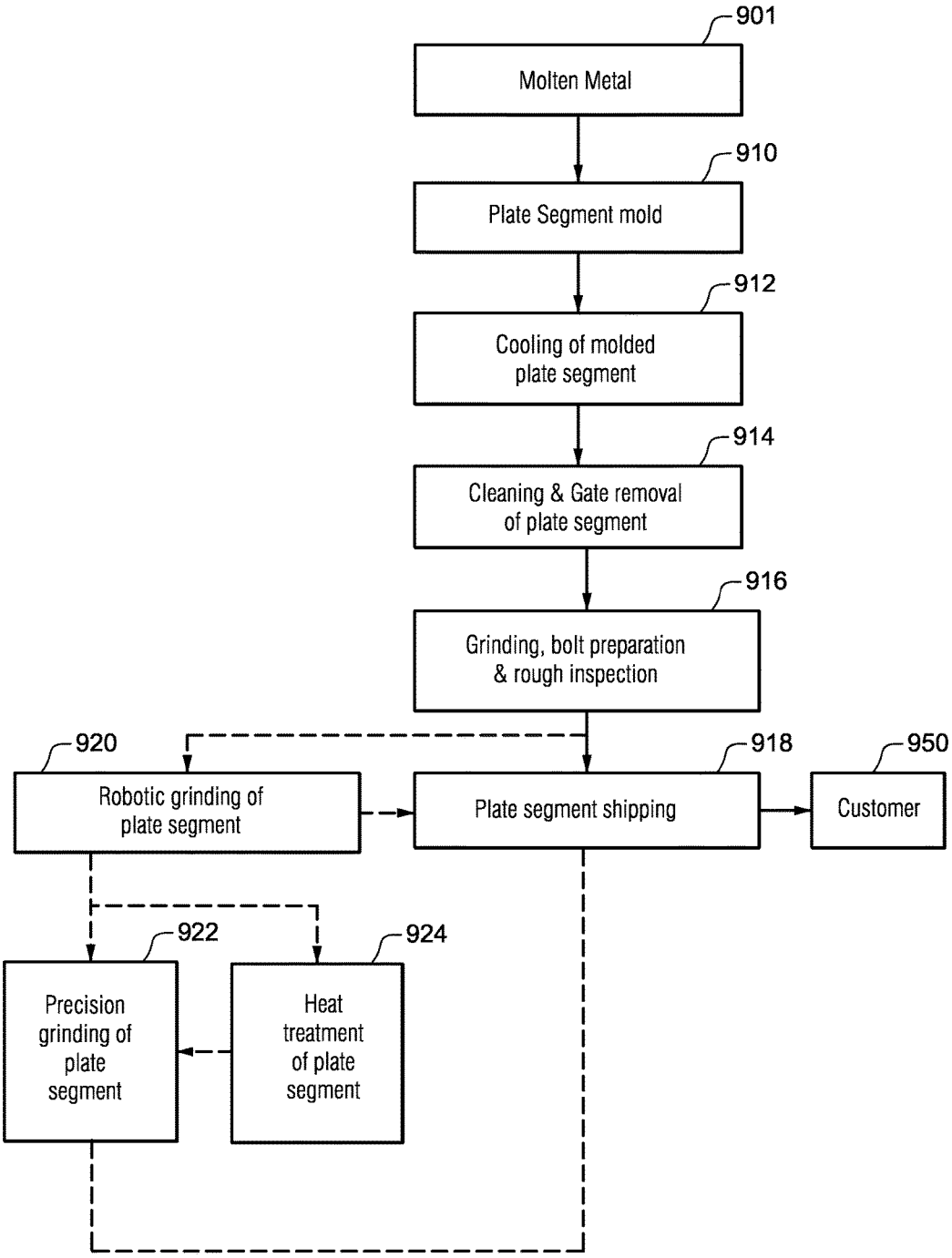
FIG. 13 is a flow chart of a method of forming a plate segment.

FIG. 13 is a flow chart showing an exemplary casting process to manufacture the plate segment. Steps shown in the flow chart that are connected by solid lines refer to preferred steps of the process. Steps connected by dotted lines indicate optional steps of the process.

The plate segments may be formed by casting metal. Conventional manufacturing processes include pouring melted metal into a mold having the desired design for the specific plate segment of interest. Once the molded plate segment has cooled, the plate segment is removed from the mold and sent for cleaning and gate removal followed by grinding and rough inspection including bolt hole preparation, a second grinding step, robotic grinding of the plate segment prior to heat treatment and precision grinding.

For the light weight plate segments disclosed herein, a modified conventional manufacturing process is possible. The modified manufacturing process provides a lighter weight plate segment, thereby significantly reducing manufacturing steps and cost of manufacturing without adversely impacting the strength of the new, lighter weight plate segment.

Manufacturing of the light weight plate segment design begins with casting of the plate segment by taking molten metal 901, and pouring molten metal into a mold 910. The mold to be used has the new back face surface design that is largely devoid of raised surfaces, such as the conventional network of ribs and particularly the ribs around the edges and sides of the segment. The mold may include features for forming the raised surfaces, such as the post, positioning section and mass support ribs. Once the mold has been filed with molten metal, the molded plate segment is allowed to cool 912 to a temperature that is sufficient for safe handling.

The cooled light weight plate segment is removed from the mold. The molded plate is cleaned and molding gates are removed 914 by grinding. Rough inspection and bolt hole preparation are also performed on the molded light weight plate segment. At this point the light weight plate segment may be ready for shipment 918 to the customer 950, or optionally, the light weight plate segment may undergo the manufacturing steps of robotic rough grinding 920 and possibly precision grinding 922, and heat treatment 924 before shipment 918. If the optional manufacturing process step of heat treatment is excluded, the metal material used to form the light weight plate segment may have sufficient strength to produce a light weight plate segment such that a heat treatment step is unnecessary.

Due to the lower manufacturing costs of the light weight plate segment, a mill plan with refiners or dispersers may be able to afford more frequent replacement of sets of plate segments. Replacement of the light weight plates can be accomplished more easily, in less time and safer as compared to heavier plates. More frequent replacement of plates allows for more efficient refining or dispersing because the plates are replaced before their bars or teeth become dull or broken.

When an inner ring is present, the light weight plate segments may be removed from the stator and rotor discs without removing the inner ring itself. The inner ring may be incorporated to the center cap of the disc. When the inner ring becomes damaged or requires replacement it is removed at the same time as the light weight plates.

Using the combined light weight plate segment and the inner ring in the inner diameter of the light weight plate segment will result in multiple advantages over the conventional plate segments used in refining and dispersing machines. These advantages include: less material needed to manufacture the plate segments; ease of removing and installing the plate segments thereby reducing time required to remove and install plate segments; reduced transportation costs for both the new plate segments being delivered to the mill and the cost to return used plate segments (used plate segments are typically returned to the manufacturer so the metal can be reclaimed); because of the lighter weight of the plate segments, handling of the light weight plate segments is safer for the mill personnel as well as others involved in the transport of the plate segments.

In another alternative embodiment, the backside of the light weight plate segment may have a groove space on the backside of the plate segment to hold a seal. The groove space for the seal is set back, radially inward from the edge of the inner periphery of the backside of the light weight plate segment. The seal material is a flexible material capable of withstanding the operating (temperature, chemical, etc.) environment of the machine without decomposing while holding the light weight plate segment to the mounting surface of the disc.

While preferred embodiments have been shown and described, various modifications and substitutions may be made thereto without departing from the spirit and scope of the invention. Accordingly, it is to be understood that the present invention has been described by way of illustration and not limitation.

We claim:

1. A plate segment configured to be mounted on a disc of a disperser or refiner of comminuted cellulosic material, the plate segment comprising:

a front face including disperser teeth or refining bars;

a back face opposing the front face, the back face including a raised post surrounding a hole configured to receive a fastener a raised plate positioning section;

lateral sides extending between the front face and the back face; and a radially outer side and a radially inner side extending between the lateral sides, wherein the radially inner side comprises a contact edge;

wherein the back face lacks raised structures along the lateral aides, wherein the raised post and raised plate positioning section each have contact surfaces, wherein the contact surfaces and the contact edge are aligned in a common contact plane, and wherein the back face is not configured to abut a disc of a disperser or a refiner of comminuted cellulosic material.

2. The plate segment in claim 1, wherein the raised post is configured to be aligned along a radial line extending from a rotational axis of the disperser or refiner.

3. The plate segment in claim 1 further comprising a second raised post and a second plate positioning section configured to be aligned along a radial line extending from a rotational axis of the disperser or refiner.

4. The plate segment in claim 1, wherein the radially outer side is devoid of a raised structure.

5. The plate segment in claim 1 further comprising a rib extending radially outward from the raised post to the plate positioning section.

6. The plate segment of claim 1, wherein the radially inner side of the back face further comprises a contact edge disposed at or near the common contact plane.

7. An assembly of a disc and a plate segment for a refiner or disperser comprising:

a plate segment including a front face having disperser teeth or refining bars, a back face having a raised post surrounding a hole configured to receive a fastener-and a raised plate positioning section;

lateral ides extending between the front face mad back face, and a radially outer side and a radially inner side extending between the lateral side, wherein the back face lacks raised structures along the lateral aides, and wherein the raised post and raised plate positioning section each have contact surfaces, and the contact surfaces are aligned in a common contact plane; and a disc having a disc mounting surface configured to mount the plate segment, wherein the disc mounting surface abuts the raised post and the plate positioning section of the plate segment, a spaced region between the plate segment back face and the disc mounting surface, wherein the back face does not abut the disc mounting surface except for the contact surface on the raised post and the contact surface on the raised plate positioning section.

8. The assembly of claim 7 further comprising plate segments mounted side by side on the disc mounting surface to form an annular array on the mounting surface of the disc, and wherein the plate segments are not mounted to adjacent plate segments.

9. The assembly of claim 7 further comprising an annular ring on the disc mounting surface, wherein the annular ring is radially inward and adjacent to the radially inner side of the plate segment.

10. The assembly of claim 7, wherein a surface of the radially inner side of the plate segment faces a surface of an annular ring.

11. The assembly of claim 10, wherein an annular space between the facing surfaces has a width in a range of 0.5 millimeters to 2.5 millimeters.

12. The assembly of claim 10, wherein a surface of the radially inner side of the plate segment faces a surface of the annular ring and the surfaces form an annular partial space configured to receive an annular seal.

13. The assembly of claim 10, wherein the surface abut at points along the inner wall of the plate segment.

14. The assembly of claim 10, wherein the surfaces each have a grooved apace, and the grooved spaces form a track to receive an annular seal.

15. The assembly of claim 14, wherein the annular seal is a deformable seal.

16. The assembly of claim 14, wherein the annular seal is in a shape of circular, oval, rectangular, triangular, octagonal, or combinations thereof.

17. The assembly of claim 7, wherein a surface of the radially inner side of the plate segment faces a surface of the annular ring, and the surfaces are parallel to each other and oblique to a direction of an axis of a refiner or a disperser.

18. The assembly of claim 17, wherein the surface of the annular ring includes a lip extending underneath the plate segment.

19. The assembly of claim 17, wherein the inner ring has a thickness greater than the thickness of the plate segment at the radially inner side, such that the radially inner side does not abut the disc mounting surface.

20. The assembly of claim 7, wherein the radially inner side of the back face further comprises a contact edge disposed at or near the common contact plane.

21. A plate segment mounted on a disc of disperser or refiner of communicated cellulosic material comprising:

a front face, including disperser teeth or refining bar;

a back face opposing the front face, the back face including a raised post surrounding a hole configured to receive a fastener and a raised plate positioning section;

lateral sides of the front face and the back face;

a radially outer aide ad a radially inner side extending between the lateral sides; and a grooved space on the back fire and adjacent to the radially inner side, the grooved space being configured to receive a seal, wherein the beck face lacks raised structures along the lateral ides, wherein the raised post and raised plate positioning section each have contact surfaces aligned in a common contact plane, wherein the radially loner side of the back face is aligned with the common contact plane, and wherein the back face is mot configured to abut a disc of a disperser or a refiner of comminuted cellulosic material.

22. A method to form a plate segment comprising:

casting a plate segment by pouring a molten metal into a mold, wherein the mold includes impressions, wherein the impressions form a plate segment having:

a front face including disperser teeth or refining bars, a back face opposing the front face, the back face including a raised post surrounding a hole configured to receive a fastener a raised plate positioning section, lateral sides extending between the front face and the back face, a radially outer side and a radially inner side extending between the lateral sides, wherein the radially inner side comprises a contact edge, wherein the back face lacks raised structures along the lateral sides, wherein the raised post and raised plate positioning section each have contact surfaces, wherein the contact surfaces and the contact edge are aligned in a common contact plane, and wherein the back face is not configured to abut a disc of a disperser or a refiner of comminuted cellulosic material;

cooling the plate segment and removing the plate segment from the mold after pouring the molten metal to form a cooled plate segment;

cleaning and removing carting gases from the cooled plate segment; and grinding the cooled plate segment.

23. The method of claim 22, wherein the grinding of the plate segment includes an automated robotic rough grinding stop followed by a manual precision grinding step.

24. The method of claim 22, wherein the plate segment is configured for use in a refiner or a dispenser.

25. The method of claim 22, wherein the depressions in the mold for the back face are limited to depressions for at least one fastener support post, at least one plate positioning section radially aligned with each fastener support post, and at least one rib extending between each aligned fastener support post and plate positioning section.

* * * * *